US006557280B2

(12) United States Patent
Seidel

(10) Patent No.: US 6,557,280 B2
(45) Date of Patent: May 6, 2003

(54) SOUND EMITTING ADVERTISING DISPLAY DEVICE

(76) Inventor: Gregg A. Seidel, 873 9th St., Manhattan Beach, CA (US) 90266

( * ) Notice: Subject to any disclaimer, the term of this patent is extended or adjusted under 35 U.S.C. 154(b) by 0 days.

(21) Appl. No.: 09/899,049

(22) Filed: Jul. 5, 2001

(65) Prior Publication Data

US 2003/0005610 A1 Jan. 9, 2003

(51) Int. Cl.[7] ..... G09F 27/00

(52) U.S. Cl. ..... 40/455; 40/514; 40/515; 40/517; 40/717; 40/906; 446/3; 446/297; 446/307; 446/397

(58) Field of Search ..... 40/455, 906, 717, 40/514, 515, 517; 446/297, 307, 397, 3

(56) References Cited

U.S. PATENT DOCUMENTS 3,245,635 A * 4/1966 Signor
3,466,776 A * 9/1969 Paige
3,958,752 A * 5/1976 Pieszchala ..... 116/215
4,102,067 A * 7/1978 Tarrant ..... 40/455
4,292,751 A * 10/1981 Snyder, Jr. ..... 40/517
4,679,822 A * 7/1987 Wolfe ..... 40/514
5,097,611 A * 3/1992 Smollar et al. ..... 40/514
5,814,749 A * 9/1998 Sui et al. ..... 84/600
6,038,800 A * 3/2000 Seidel ..... 40/514
6,039,453 A * 3/2000 Wang ..... 362/101
6,176,028 B1 * 1/2001 Walsh et al. ..... 40/514
6,199,439 B1 * 3/2001 Lin ..... 40/455
6,301,812 B1 * 10/2001 Klunk ..... 40/514
6,384,726 B1 * 5/2002 Epple et al. ..... 340/545.6

* cited by examiner

*Primary Examiner*—D. Glenn Dayoan
*Assistant Examiner*—Lori L Coletta
(74) *Attorney, Agent, or Firm*—Jack C. Munro

(57) ABSTRACT

A sound emitting advertising and information display device which has a roller housing which has an internal chamber. A sheet member is wound on a roller and is contained within the internal chamber. The sheet member is to be manually extendable from the housing with advertising indicia that is located on the sheet member to then be capable of being read by a human. During the time of extending of the sheet member, a sound is emitted that is to correspond with the advertising indicia. The advertising display device is to be attached to the front end of a product supporting shelf in a store.

13 Claims, 1 Drawing Sheet

2
24
30
70
10
15
26

4
70
56
50
48
44
46
42
30
20
40
26
38
34
18
28
12
15
14
58
52
16

70
16
50
48
44
46
42
30
38
40
18
22
32
36
52
34
20
12
15
28
14
56
63
58

56
58
16
64
14
62
60
26
54
50
52
54
48
44
61
66
68
66
46
42
30
12
26

SOUND EMITTING ADVERTISING DISPLAY DEVICE

BACKGROUND OF THE INVENTION

1. Field of the Invention

The field of this invention relates to display apparatuses and more particularly to an advertising and information display which is designed to not only display words and/or drawings but also is designed to emit a sound which corresponds to the words and/or drawings and which is designed to be mounted on the front edge of a product supporting shelf within a store on an in-store display fixture or on a free standing display.

2. Description of the Related Art

Typical self service retail stores, such as drugstores, supermarkets, pet stores, convenience stores, toy stores, mass merchandise stores, home improvement stores, computer software stores, liquor stores, and the like, have rows of multiple tier shelves which are to be used to support products for sale. The product, or the exterior package of the product, is visually displayed on the shelf. Generally, there are many units of a particular product stocked on that shelf. The consumer will normally select a product from the shelf without the assistance of a clerk. Therefore, the shelf also performs a dispensing function.

It is common for product manufacturers and distributors to want to include a display advertisement at their shelf location for a particular product. While a product is readily visible on a shelf, the mere presence of a product, because the product is displayed with numerous other products on the shelf, may be insufficient to stimulate consumer interest. Shelf space in a store is a valuable commodity. The amount of shelf space assigned to each product is at a minimum. A given product can become "lost" on a shelf amongst all the other products. Also, the product may be enclosed in a small package so that there is no large "advertising" surface to catch the consumer's eye or the available space on a package may be insufficient to contain all the information that a manufacturer or retailer wishes to impart to a potential purchaser. Additionally, the product may be packaged in a plain wrapping or, in the case of produce, no package at all. There also may be involved some specialty promotion with the product that is not included on the package since the promotion may only run for a short period of time.

Manufacturers and retailers are becoming aware that shelf advertising can be an exceedingly effective way in which to sell goods. Not only can the advertising motivate a consumer's purchase, but it also can be informative to the consumer about the product. Shelf advertising is limited as to its available space. The only convenient location for shelf advertising is at the front edge of the shelf which is short in length. The shelf area in front of a product is usually no more than four to ten inches in length, and generally the shelf is only an inch to one inch and a half in height. Some shelf edges can be as high as four to six inches as in pet stores and home improvement stores. However, if some form of device could be mounted on the front edge of the shelf and the device constructed in a manner to be expandable to a larger area so that the additional information can be printed on the larger area and then made available to the consumer only when the consumer is interested in obtaining that information, then such an advertising device would be most desirable. Also, when a consumer is not utilizing the device, the device assumes a retracted state occupying a minimal amount of space when it is not used.

In the past, it has been known to mount a scroll type of device on the front end of a shelf with the scroll to be unwound to display written advertising or information about a product, and when then released by the consumer, the device retracts to a small size, at rest position. However, in the past, such scroll types of devices have been constructed to be complex and not capable of being manufactured at a relatively inexpensive cost which is inherently necessary in order for widespread usage of such devices. Another problem with former scroll devices is that such visually blocked the price channel without including a space for the retailer to place price, inventory, or barcode label. Modern stores rely on these labels to price, manage inventory and reorder stock. Additionally, such scroll type devices of the prior art have not been easily mountable on the front edge of modern shelving requiring the use of an unattractive and rather large size C-type of clamping device that is to be used to clamp onto the shelf. It would be far more desirable to have such an advertising device be quickly and easily attached and detached at the front edge of a shelf, specifically to the price channel, without utilizing bulky and unattractive clamping devices. Such a desirable form of advertising device has been obtained by the present inventor within U.S. Pat. No. 6,038,800. However, the advertising display device of this patent was limited to the use of words and/or images in relation to the advertising information. It would be desirable to construct an advertising display device that also included audio information that correlated to the printed information.

SUMMARY OF THE INVENTION

The basic embodiment of sound emitting advertising display device of the present invention utilizes a roller housing with a roller rotationally mounted therein, a sheet member is attached to the roller and extends through a slot in the roller housing. A windup spring biases the roller such that it tends to retract the sheet member into the roller housing. A pull handle is attached to the free end of the sheet member which prevents such from retracting totally to within the roller housing. Pulling on the pull handle extends the sheet member so that an advertising message printed thereon may be read and simultaneously causes an audio message to play. The roller has an actuator which connects to a tripping mechanism which is tripped automatically upon extension of the sheet member from the roller housing. This tripping mechanism will then activate the audio message.

A further embodiment of the present invention is where the basic invention is modified by the tripping mechanism including a rocker arm and a switch. Movement of the rocker arm by the actuator causes the switch to be moved from an open position to a closed position thereby activating the audio message.

A further embodiment of the present invention is where the basic embodiment is modified by the tripping mechanism being located exteriorly of the roller housing.

A further embodiment of the present invention is where the basic invention is modified by the audio message comprising a taped message.

A further embodiment of the present invention is where the basic embodiment is modified by including of a sound housing connected to the roller housing with this sound housing to include a taped message emitter and an audio speaker.

A further embodiment of the present invention is where the just previous embodiment is modified by the sound housing including a first battery source to supply electrical power between the emitter and the speaker.

A further embodiment of the present invention is where the just previous embodiment is modified to include a second battery source to also supply electrical power between the emitter and the speaker.

A further embodiment of the present invention is where the basic embodiment is modified by the actuator comprising a cam wheel with the cam wheel to produce essentially noiseless activation of the tripping mechanism.

BRIEF DESCRIPTION OF THE DRAWING

For a better understanding of the present invention, reference is to be made to the accompanying drawings. It is to be understood that the present invention is not limited to the precise arrangement shown in the drawings.

DETAILED DESCRIPTION OF THE INVENTION

Figures 1, 2, 3, 4:
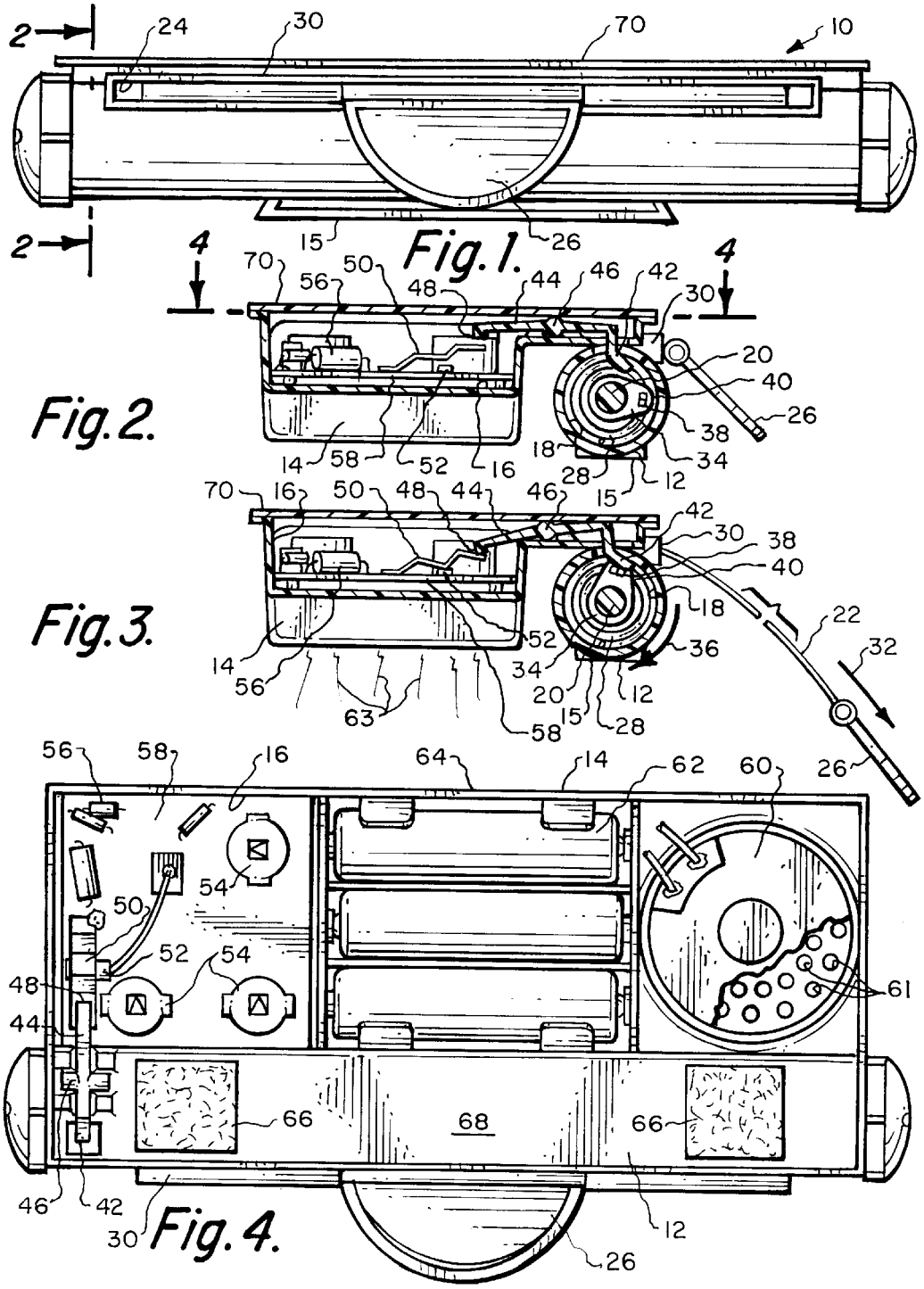
FIG. 1 is a bottom view of the sound emitting advertising display device of the present invention showing the sheet member in conjunction with the advertising display device in the retracted position.
FIG. 2 is a transverse cross-sectional view through the sound emitting advertising display device of the present invention taken along line 2—2 of FIG. 1 where the extendable sheet member is shown in the retracted position.
FIG. 3 is a cross-sectional view of the sound emitting advertising display device of the present invention similar to FIG. 2 but where the extendable sheet member is in an extended position.
FIG. 4 is a top plan view, partly in cross-section, of the sound emitting advertising display device of the present invention taken along line 4—4 of FIG. 2.

Referring particularly to the drawings, there is shown the sound emitting advertising display device 10 of this invention which includes a roller housing 12, which is basically cylindrical in configuration, and a sound emitter housing 14. A sound emitter housing 14 is attached to the roller housing 12. The sound emitter housing 14 has an internal chamber 16. Roller housing 12 has an internal chamber 18. Rotatably mounted along a longitudinal axis within the internal chamber 18 is a roller 20. Attached to the roller 20 is the inner end of a sheet member 22. The width of the sheet member 22 is to be just short of the length of the roller housing 12. Written or drawn (text and/or images) on the sheet member 22 is to be advertising indicia, which is not shown. This advertising indicia is to be located on the upper surface of the sheet member 22 when the sheet member 22 is in the extended position, which is depicted generally in FIG. 3 of the drawings. The sheet member 22 passes through an elongated slot 24 formed within a slot housing 30 which is part of roller housing 12 and is attached to roller 20 parallel to the longitudinal axis of roller 20. The outer end of the sheet member 22 is attached to a pull handle 26.

The roller 20 is connected to a windup spring 28. The windup spring 28 exerts a continuous bias on the roller 20 tending to locate the sheet member 22 in the retracted position with the pull handle 26 located directly against slot housing 30. The pull handle 26 is wider and/or longer than the slot 24 so that it will not allow the windup spring 28 to pull the free end of the sheet member 22 through the slot 24 into internal chamber 18. Pulling on handle 26 causes extension of the sheet member 22 in the direction of arrow 32. At the same time, the roller 20 is rotated with the bias of the windup spring 28 increasing. Additionally, an actuator, which is in the form of cam wheel 34, is fixedly mounted on the roller 20 and is rotated or pivoted in the direction of arrow 36. The cam wheel 34 (when viewed axially) includes a segment of constant radius and a lobe 40 with increasing then decreasing radius. The cam wheel 34 includes a slot which connects at the inner end 38 of the windup spring 28. Therefore, rotating of the cam wheel 34 causes the windup spring 28 to be wound tighter. The spring 28 may be located at the opposite end of roller housing 12 and not connected to cam wheel 34. As the cam wheel 34 rotates, lobe 40 will come into contact with the inner end 42 of a tripping mechanism in the form of a rocker arm 44. Rocker arm 44 acts as a cam follower with end 42 in contact with cam wheel 34. The rocker arm 44 is pivotally mounted at its mid-point 46 to the sound emitter housing 14. The outer end 48 of the rocker arm 44 is to be pushed against switch arm 50 when the lobe 40 contacts the inner end 42. The rocker arm 44, at this time, is then pivoted in a counterclockwise direction depressing the switch arm 50. The switch arm 50 in conjunction with switch contact 52 comprise a normally open electrical switch. The switch arm 50 also biases the rocker arm 44 against the cam wheel 34. Depressing of the switch arm 50 will push against switch contact 52 closes an electrical switch which will cause electrical power to be supplied by a first set of batteries 54 through the electrical components 56 mounted on a printed circuit board 58 to a sound generator device which in turn will cause a taped message to be emitted (represented by lines 63) from speaker 60 through holes 61 of housing 14. As the cam wheel 34 continues to rotate, it will repeatedly contact the rocker arm 44 by lobe 40. However, only the first contact matters to cause activation of the taped message. The sound generator device comprises an integrated circuit chip (not shown), a printed circuit board 58, support components 56, a speaker 60 and batteries 54. Also mounted within the sound emitter housing 14 is a second series of batteries 62. The use of the second series of batteries 62 is deemed to be optional and instead of batteries 54. The first series of batteries 54 will power the sound during extension of the sheet material 22 approximately five hundred to one thousand times. By using of the second set of batteries 62, the sound can be produced with the sheet material 22 being extended literally thousands of times (five thousand to ten thousand).

Along the edge 64 of the sound emitter housing 14 is to be located an adhesive strip, which is not shown. Adhesive pads 66 are to be mounted on the planar ledge 68 of the sound emitter housing 14. A protective cover 70 is to be placed against the adhesive strip on the edge 64 and on the pad 66. It is the function of the protective cover 70 to prevent foreign material to enter within the internal chamber 16 and also to prevent the structure that is within the internal chamber 16 from being observed. Normally, the protective cover 70 will include advertising indicia, which is not shown.

The roller housing 12 is to be connected by an appropriate securing means to a shelf edge (not shown). Typical securement would be by means of adhesive pads or some type of a shelf bracket customized to the shelf to which it is to be attached. The roller housing 12 has a planar mounting strip 15 upon which is to be the securement to the shelf edge. In observing of FIGS. 2 and 3, the sound housing 14 and the roller housing 12 is to be turned ninety degrees when attached to the shelf edge or when attached to any other solid surface.

What is claimed is:

1. A sound emitting advertising display device comprising:

a roller housing having an internal chamber;

a roller rotationally mounted to said roller housing, said roller being located within said internal chamber;

a windup spring located within said internal chamber, said windup spring being mounted between said roller and said roller housing;

a sheet member having an inner end and an outer end, said inner end being secured to said roller, said sheet member to contain advertising indicia, a pull handle mounted on said outer end, whereby said sheet member is to be wound on said roller as said roller is rotated with rotation of said roller causing compressing of said windup spring which exerts a bias onto said roller to tending to locate said sheet member in a tightly wound position with said pull handle located directly adjacent said roller housing, whereby said pull handle can be manually moved away from said housing causing extension of said sheet member exteriorly of said housing causing exposing of the advertising indicia, and upon release of said pull handle, said bias of said windup spring will cause the sheet member to be rewound on said roller; and an actuator mounted on said roller, said actuator to contact a tripping mechanism causing the production of an audio message in the form of words or music which is to correspond to the advertising indicia.

2. The sound emitting advertising display device as defined in claim 1 wherein:

said tripping mechanism includes a rocker arm and a switch, movement of said rocker arm by said actuator causes said switch to move from an open position to a closed position.

3. The sound emitting advertising display device as defined in claim 2 wherein:

said tripping mechanism being located exteriorly of said roller housing.

4. The sound emitting advertising display device as defined in claim 1 wherein:

said audio message comprising a taped message.

5. The sound emitting advertising display device as defined in claim 1 wherein:

a sound housing connected to said roller housing, said sound housing including a taped message emitter and an audio speaker.

6. The sound emitting advertising display device as defined in claim 5 wherein:

said sound housing including a first battery source to supply electrical power between said emitter and said speaker.

7. The sound emitting advertising display device as defined in claim 6 wherein:

said sound housing including a second battery source located spaced from said emitter but also to supply electrical power between said emitter and said speaker, said second batter source being located within said sound housing.

8. The sound emitting advertising display device as defined in claim 1 wherein:

said actuator mechanism comprising a cam wheel, said cam wheel to produce essentially noiseless actuation of said tripping mechanism.

9. A sound emitting advertising display device comprising:

a housing having an internal chamber;

a roller rotationally mounted to said housing, said roller being located within said internal chamber;

a sheet member having an inner end and an outer end, said inner end being secured to said roller, said outer end being accessible external to said housing, said sheet member being located in either a retracted position wound on said roller or in an extracted position stretched outward from said roller;

a windup spring connected to said housing and to said roller and biased such that it tends to locate said sheet member in said retracted position into said internal chamber;

a sound generating device capable of creating an audible, intentional and significant sound; and an actuator which activates said sound generating device when said sheet member is moved from said retracted position to said extended position.

10. The sound emitting advertising display device as defined in claim 9 wherein:

said sheet member includes a written advertising message.

11. A sound emitting advertising display device comprising:

a housing having an internal chamber;

a roller rotationally mounted to said housing, said roller being located within said internal chamber;

a sheet member having an inner end and an outer end, said inner end being secured to said roller, said outer end being accessible external to said housing;

a windup spring connected to said housing and to said roller and biased such that it tends to retract said sheet member into said internal chamber;

a sound generating device capable of creating an audible, intentional and significant sound;

an actuator which activates said sound generating device;

movement of said sheet member causes said actuator to activate said sound generating device; and said actuator consists of a cam wheel attached to said roller, said cam wheel to contact an electrical switch to cause activation of said sound generating device.

12. The sound emitting advertising display device as defined in claim 11 wherein:

there being a rocker arm located between said switch and said cam wheel.

13. The sound emitting advertising display device as defined in claim 12 wherein:

said cam wheel in conjunction with said rocker arm produces essentially noiseless activation of said sound generating device.

* * * * *